United States Patent [19]

Colombetti

[11] 4,039,835

[45] Aug. 2, 1977

[54] RELOADABLE RADIOACTIVE GENERATOR SYSTEM

[76] Inventor: Lelio G. Colombetti, 3300 N. Lake Shore Drive, Apt. No. 14D, Chicago, Ill. 60657

[21] Appl. No.: 666,186

[22] Filed: Mar. 12, 1976

[51] Int. Cl.[2] ..... G21G 4/08

[52] U.S. Cl. ..... 250/432 PD

[58] Field of Search ..... 250/432 PD

[56] References Cited

U.S. PATENT DOCUMENTS

| | | | |
|---|---|---|---|
| 3,576,998 | 5/1971 | Deutsch et al. | 250/432 PD |
| 3,774,035 | 11/1973 | Litt | 250/432 PD |

*Primary Examiner*—Davis L. Willis

[57] ABSTRACT

A generator system that can be reloaded with an elutable radioactive material, such as 99 molybdenum, a multiple number of times is described. The system basically comprises a column filled with alumina, a loading vial containing a predetermined amount of the elutable radioactive material, and a rinsing vial containing a sterile solution. The two vials are connected by a conduit so that when communication is achieved between the column and loading vial and an evacuated vial is placed in communication with the bottom of the column, the predetermined amount of the radioactive material in the loading vial will be transferred to the column. The procedure can be repeated as the elutable material in the column is dissipated.

10 Claims, 3 Drawing Figures

---- PREPARED WITH CARRIER 98MO (A)

—— PREPARED WITHOUT

99Mo BREAKTHROUGH
(μCi 99Mo/mCi 99mTc)
99mTc ACTIVITY IN ELUATES
(in mCi/TOTAL VOLUME)
350
300
250
200
150
100
50%
0.075
0.05
0.025
0.0
1
2
3
4
5
6
11
12
DAYS
WEEKS

RELOADABLE RADIOACTIVE GENERATOR SYSTEM

BACKGROUND OF THE INVENTION

Radioactive isotopes are extensively used for the diagnosis and treatment of various medical conditions. Certain radioactive isotopes have so short a half-life however that they cannot be shipped. Such isotopes are therefore prepared at time of use. one such isotope is the 99m isotope of technetium (99mTc) which is used in many medical procedures such as for the localization of brain tumors. (See Smith, J. Nuc. Med., Vol. 5, p. 871–882, 1964). The 99m isotope of technetium has a half-life of 6 hours and is obtained as the daughter product of molybdenum $Mo^{99}$, adsorbed on an alumina column, by elution with saline solution. A suitable column and process for preparing technetium 99m is described in U.S. Pat. No. 3,440,423, issued Apr. 22, 1969. As noted, the radioactive pertechnetate which is obtained is useful in brain scanning or can be converted to other compounds such as labeled technetium sulfide for examination of the liver. Another use, as technetium-labeled albumin, is for placental scanning.

One of the disadvantages of the $^{99}$Mo-99mTc generators as presently known, is that every week a new generator, packed in a bulky load of many pounds of lead inside an expensive packaging case has to be sent to the user.

With these types of generators, Boyd (see IAEE, Vol. I: 3–26, 1973), found that the first few milliliters of eluates contained the major portion of $^{99}$Mo breakthrough, and that since these $^{99}$Mo components can be removed by filtration, he concluded that the $^{99}$Mo is associated with particulate matter arising from the bed, in other words, alumina. This fact suggests, that the $^{99}$Mo found in eluates is still strongly bound to the alumina, and does not break free during elution.

Reese and Mishkin (Am. J. Roentg, 103: 896, 1968) and Lo, et al. (Radiology 93: 1198–1199, 1969) found that the use of tandem generators resulted in a lesser leakage of $^{99}$Mo., probably because of the filtration-like function for particulate material of the second generator or maybe, because the $^{99}{}_{Mo}$ in solution, if any, was reabsorbed.

SUMMARY OF THE INVENTION

A generator system that can be reloaded with 99 molybdenum ($^{99}$Mo) every week for a multiple of weeks, and safely eluted every day, is described. The generator system basically comprises a column filled with alumina, a loading vial containing a predetermined amount of $^{99}$Mo, and a rinsing vial containing a sterile solution, preferably saline solution. The two vials are connected by a conduit such as plastic tubing, so that when communication is achieved between the column and loading vial through a double-ended needle or other means in the top of the column, and an evacuated vial is placed in communication with the bottom of the column, the predetermined amount of the $^{99}$Mo in the loading vial will be transferred to the column, and the column, as well as the loading vial will be rinsed with the solution in the rinsing vial.

Such generators can be reloaded with $^{99}$Mo every week, for a large number of weeks and have been used for periods of up to 3 months. The generators were loaded once a week with up to 600 mCi of $^{99}$Mo and eluted almost every day. Daily testing showed that this system can be applied safely for nuclear medicine, since breakthrough of $^{99}$Mo was always less than 0.1 uCi of $^{99}$Mo per mCi of 99mTc. Also, breakthrough of alumina was always below 6 ug./ml. of eluate.

The system can be prepared in a way as to make it safe from a sterility and apyrogenicity viewpoint and has multiple advantages, such as an easier waste disposal, reduced production and shipping cost, since the lead shielding for the generator will have to be shipped only one every few months. Finally, $^{99}$Mo will be used more efficiently.

DRAWINGS

The invention will be better understood from the following description and drawings, in which.

DETAILED DESCRIPTION OF THE INVENTION

Figure 1:
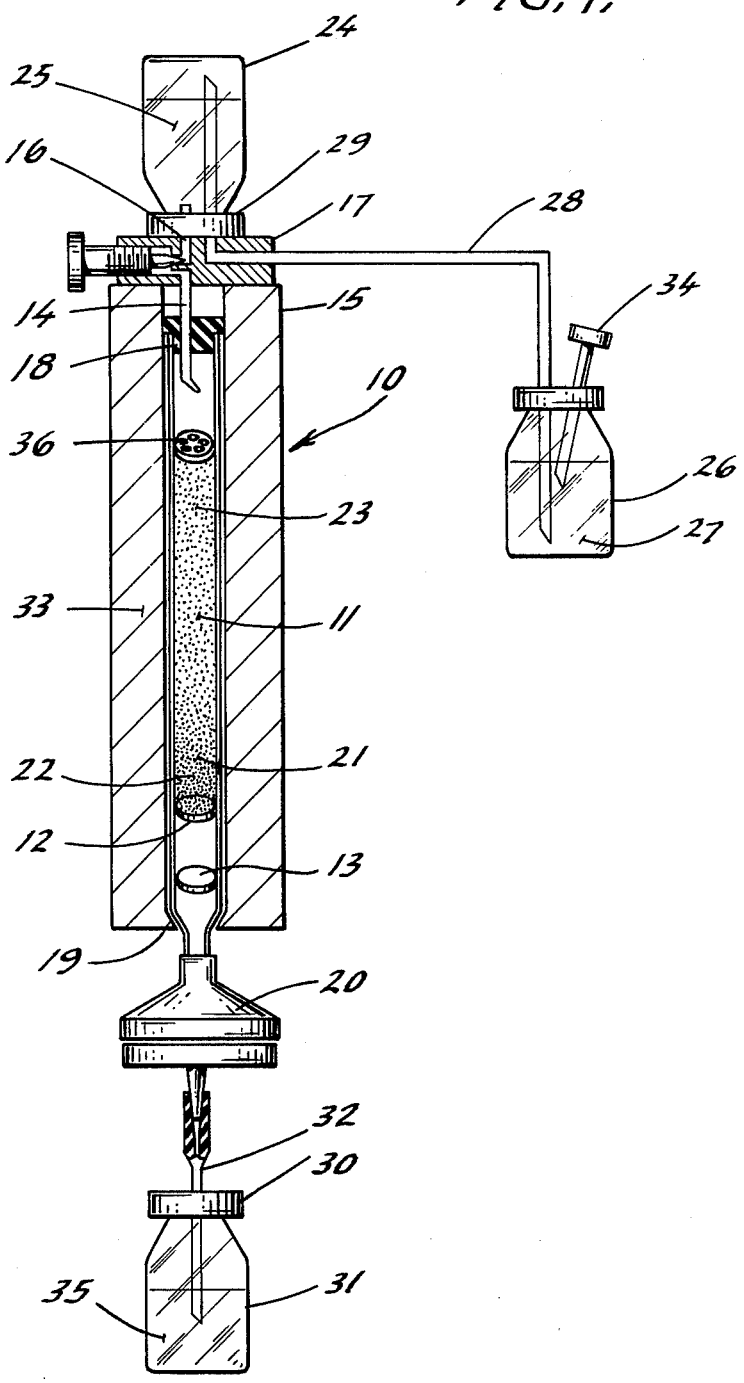
FIG. 1 illustrates a generator system of the present invention.

The columns 11 can be made of Pyrex glass or preferably, polypropylene, since this material does not break easily. As illustrated, they are 12 cm in length by 0.5 cm in diameter and are fitted, at the bottom, with 2 porous or fritted glass disks 12, 13 as shown in FIG. 1. The upper disk 12 is of medium pore size and the lower disk 13 is fine pore, in order to help the trapping of particulate material, which can escape from the column 11 during elution. A needle 14 or other transfer means is permanently attached to the top 15 of the generator 10 and enters a small hole 16 drilled in the lead cap 17 covering the column 11. The needle 14 penetrates the generator 10 through a rubber stopper 18 attached to the top 15 of the column 11. The needle 14 is bent slightly and does not point straight down the center of the column 11 in order not to disturb the column 11 during elution. The needle 14 serves two purposes, namely to charge the generator 10 every week with a fresh solution of molybdate-$^{99}$Mo and also for the daily elution of the generator 10. At the bottom 19 of the generator 10 a micropore filter 20, of 0.45 um pore size is preferably attached. This final filter 20 helps keep the eluates sterile, and will also trap very fine particulate material which could escape from the column 11. In this manner, the alumina contents in the eluates and also any $^{99}$Mo breakthrough, which is mostly bonded to the fine alumina particles, can be kept under control. This filter 20 is changed every week, before reloading the generator 10. The column 11 is retained within a lead shield 33. To prevent any possible radioactive radiation from escaping.

The chromatographic bed 21 is prepared by filling the column 11 with acid washed alumina ($Al_2O_3$) 22. The layer 23, about 7 cm in length, is prepared using the alumina 22 as a slurry and following standard procedures to pack chromatographic columns. The column 11 is washed two or three times with 10 ml. portions of 0.9% saline. The column 11 is then ready to be loaded with the $^{99}$Mo-molybdate solution.

The loading of the generator 10 is accomplished in a simple manner, using the system 10 shown in FIG. 1. The first container or vial 24 shown at the top of the column, the loading vial, contains the desired, predetermined amount of $^{99}$Mo salt 25, which is commercially supplied as ammonium molybdate, dissolved in 1 ml. of water. The second or other vial 26, the rinsing vial, contains 10 ml. of sterile saline solution 27. These two vials 24, 26 are connected by a conduit such as a plastic tubing 28 whose internal volume is slightly over 1 cubic centimeter. In this way, when the stopper 29 of the loading vial 24 is pierced by the needle 14, attached to the top 17 of the column 11, and the stopper 30 of an evacuated vial 31 is pierced by a needle 32 attached to the bottom 19 of the column 11, not only the $^{99}$Mo salt will be transfered to the column 11, but the column 11 as well as the loading vial 24, will be rinsed with the 10 ml. of saline solution 27 contained in the rinsing vial 26. A vent 34 is preferably included in the rinsing vial 26 to facilitate the transfer.

The loading vial 24 prior to use is protected by an appropriate lead shielding (not shown) having a lead stopper, which is removed prior to the charging of the generator. Likewise, the needle 32 at the bottom 19 of the generator 10 is changed every day, to guaranty the sterility of the eluates.

Elution of the generator 10 is achieved by using eluent vials (not shown) containing the desired amount of saline solution, and an air vent. Using sterile techniques, the eluent vial is firmly positioned on the needle 14 at the top 17 of the generator 10, The needle 14 will penetrate the stopper of the vial in a way that most of the eluent solution will be drawn down by the vacuum in the collecting vial 31 when this is attached to the needle 32 at the bottom 19 of the column 11. Before using the collecting vial 31, it is placed in a lead shield (not shown).

In order to be certain that the daily eluates from the weekly loaded generator 10 can be safely used, a series of different tests were carried out. It is believed necessary to test the eluates for: radionuclidic purity, chemical purity, sterility and apyrogenicity. Also the columns were tested, for the localization in the columns 11, of the ratioactivity due to the $^{99}$Mo.

Before the multiload generator 10 could be tested, it was believed necessary to determine the binding capacity of the alumina column 11. This was done by the addition of large amounts of cold molybdenum, before loading the generator 10 with radioactive molybdenum sale-$^{99}$Mo. Since 1 Ci of $^{99}$Mo weights only $2.1 \times 10^{-3}$ mg., the addition of 21 mg. of cold molybdenum (equivalent to 21 $\times$0 10$^{1164}$Ci of $^{99}$Mo) is sufficient. Before the first loading with $^{99}$Mo, the generator 10 was washed twice with saline and the eluates tested for molybdenum breakthrough. Molybdenum was tested using a spot test as it is explained hereinafter in chemical purity.

It is necessary to detect and measure the activity of the parent, $^{99}$Mo, breakthrough, or any other radionuclide present in the column 11 as an impurity of $^{99}$Mo, because of their importance in relation to the radiation dose absorbed by the patient, especially when the radioactive impurities are long-lived or are $\beta$-emitting radionuclides. These impurities can be measured using physical or chemical methods, but physical methods are preferred because they are more sensitive and specific. These are retrospective methods, because it is necessary to wait for the decay of the daughter before the parent or any other longer-lived impurity can be measured.

First, the principal radionuclide 99mTc was measured in a diluted aliquot of the eluate. Then, after about 10 half lives of the daughter had passed by, the content of radioactive impurities in the eluates was determined by gamma spectrometric analysis, using standard procedures.

Since this method of detecting radioactive impurities is too time consuming, total content of these impurities is determined only once a week. For the daily determinations of $^{99}$Mo breakthrough, which could be the main problem as a radioactive impurity in the eluates, the technique described by Richards and O'Brian, (J. Nucl. Med. 19: 517, 1969) can be used. This technique is not suitable to detect $^{99}$Mo breakthrough, per se, in eluates from fission $^{99}$Mo based generators, since other impurities in fission molybdenum, such as $^{131}$I, $^{132}$I and $^{103}$Ru emit more energetic and/or more abundant radiation than $^{99}$Mo and will be counted as $^{99}$Mo. In any event, if the summation of all these activities is still less than the limit for $^{99}$Mo require by the U.S.N.R.C., that is, no more than 1 u Ci of $^{99}$Mo per mCi of 99mTc or 5 uCi per dose of 99mTc administered, the radionuclidic purity is satisfactory.

The eluent can be contaminated by other nonradioactive metals used as carriers or from constituents of the column 11 itself. A generator is packed with $Al_2O_3$, which suffers from radioation damage, and consequently, alumina ion can be found in the eluates.

For chemical analysis of the eluent, emission spectrography, polyargraphy, and colorimetric spot tests are particularly valuable. Emission spectrography should be the method of choice, since it requires only a small sample and offers the opportunity of recording the presence of unexpected impurities. When a spectrograph is not available, spot tests are recommended. These tests are, in most cases, specific and highly sensitive and take only a few minutes to run. (Feigl, "Quantitative Analysis By Spot Tests," 2nd English Edition, Elsevier, 1939)

The presence of ug. of Al./ml. of eluent was determined daily, using a solution of aluminon in 5 M ammonium acetate. Aluminon is the ammonium salt of aurintricarboxilic acid which imparts a red color to the $Al(OH)_3$ formed when the solution containing aluminum ions is made alkaline. Sensitivity of this reaction is about $0.5 \times 10^{-7}$ mg.

Cold molybdenum was tested using the colorimetric spot test described by Tananaeff and Patschenko, (Chem. 261 1: 412, 1930) which is one of the most sensitive tests for this ion. This reaction is based on the formation of $K_3/Mo(CNS)_6$/having a vermilion color. The sensitivity of this reaction is about $0.1 \times 10^{-9}$mg. Other inert impurities present in the eluates were determined, once a month, using spectrographic analysis.

These tests are also impossible to make prior to injection because they are time consuming; thus for sterility and apyrogenicity one must rely on careful operation and retrospective testing. Sterility tests were done three times a week and apyrogenicity once weekly, using U.S.P. techniques, U.S.P. XVIII, 1970, pp. 851–857 and 886–887.

The elution efficiency of the generators prepared as described above, was tested, after every elution in a dose calibrator, using a diluted aliquot of the eluates. The readings were converted to activity at elution and plotted on graph paper.

The columns of the generators were tested for localization of the $^{99}$Mo radioactivity by two methods. In one method, the generators were scanned, in a horizontal position, using two lead bricks 2.5 cm thick, set in such a way that a small slit 1 mm wide was formed. Moving the generator column, from top to bottom, along the slit the radioactivity was determined by taking readings at every cm, using an ionization chamber. In the other method, two columns made with polypropylene, were prepared, and after a 5 week period of use, the generators were dismantled, and the columns, still wet, cut every 0.5 cm. The radioactivity in each one of these portions was determined using the dose calibrator.

The radioactivity trapped by the micropore filtration system at the end of the column was determined by not changing the filter for a period of 4 weeks, in two generators. After this period of time, the two filters were removed, washed twice with saline and dismantled, the filtering surface rolled, and bent over twice to reduce surface, and after placing them in a small plastic tube, 5 cm long and 0.5 cm diameter, counts were taken using a well counter.

Ten generators prepared as illustrated and using the procedure described, were tested for periods of up to 3 months. The generators were loaded every week, on Mondays, with new solution of ammonium molybdate-$^{99}$Mo and washed with 10 ml. saline. Elutions were started on Tuesdays. Last, daily elution was done the next Monday, immediately before reloading. These generators were eluted almost daily, including Saturdays and Sundays, and tests conducted as previously described.

The addition of 23.0 mg. of cold $(NH_4)_2MoO_4$ did not saturate the columns of two generators, because on both generators, there was leakage of cold molybdenum. These generators were eluted many times on the same day, using 5 ml. of saline each time. One generator was eluted 32 times and the other 58 times. All these eluates were tested for molybdenum ions and all tests were negative. After loading both generators were about 600 mCi of $^{99}$Mo they were tested for a week for breakthrough of radioactive molybdenum using gamma spectrometric analysis. It was found that all eluates contained less than 0.1 uCi of$^{99}$Mo/ml.

Figure 2:
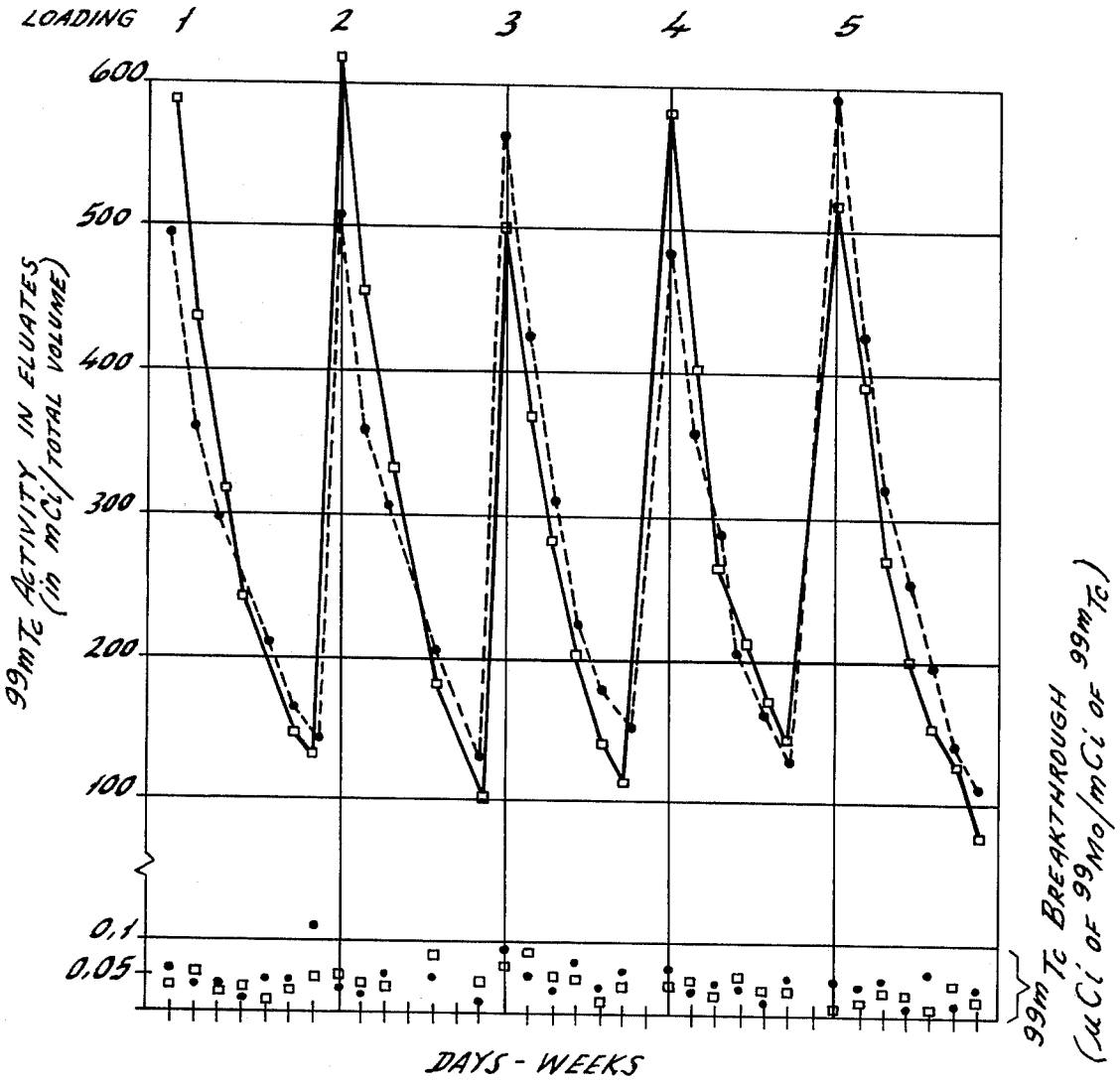
FIG. 2 illustrates the elution characteristics of two generator systems during a period of five weeks.

FIG. 2 shows the elution characteristics of two generators during a period of 5 weeks. Generator A, had 23 mg. of cold $(NH_4)_2MoO_4$ added to the column prior to the first loading with $^{99}$Mo. It can be seen that both generators functioned normally, and that breakthrough of $^{99}$Mo was minimal. Also, attempts to detect molybdenum, cold and radioactive, in the eluates, failed.

Figure 3:
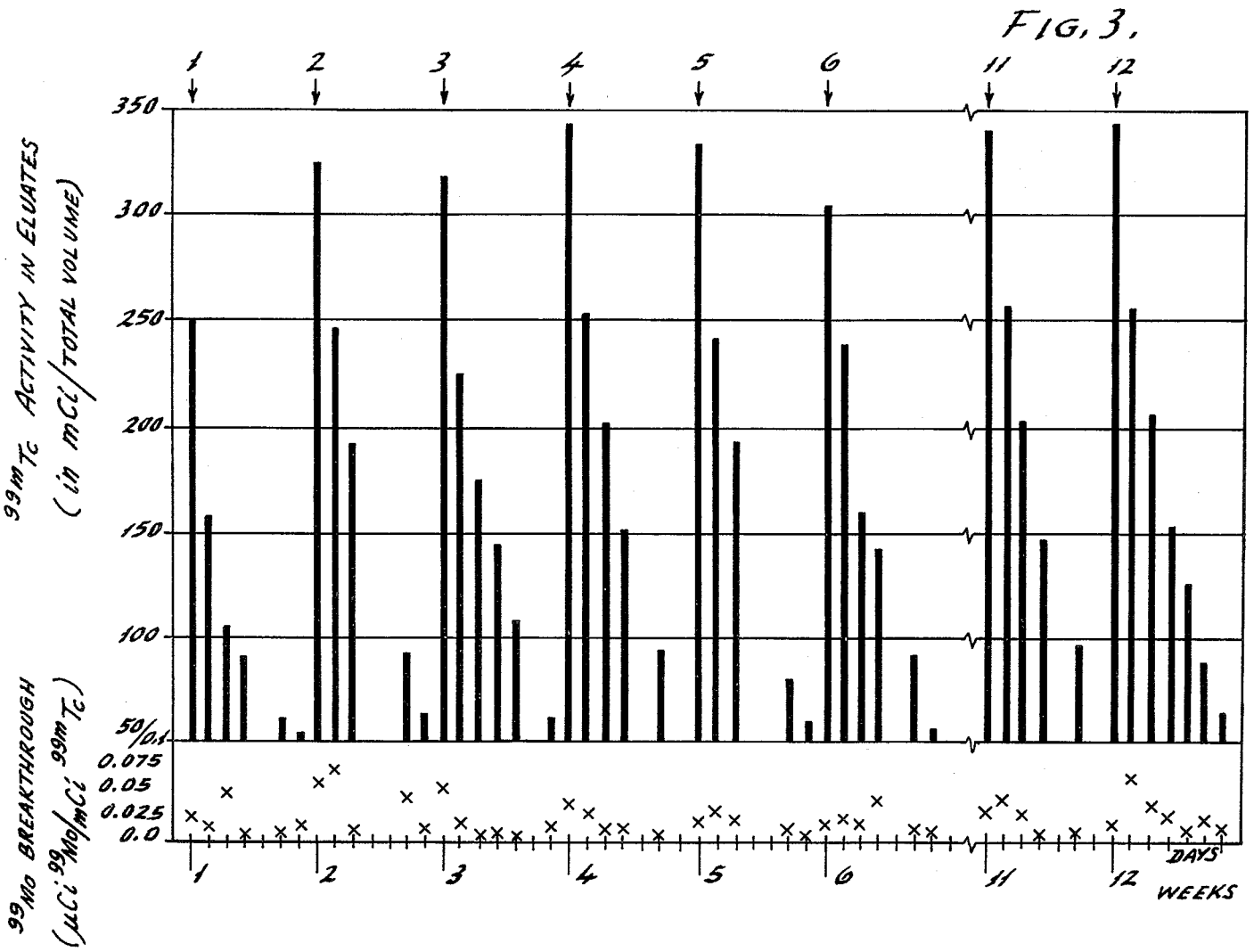
FIG. 3 illustrates the elution characteristics of a generator system over a period of three months.

Other generators prepared as explained above, were tested for periods of up to 3 months. FIG. 3 shows the results obtained with one of these generators. Elution efficiency was within the acceptable standards with about 80% of the available 99mTc being eluted by the saline solution. Also, breakthrough of $^{99}$Mo tested daily was well below requirements of no more than 1 uCi of $^{99}$Mo per mCi of 99mTc.

Table 1 illustrates the results of scanning the columns from FIG. 3. As can be seen, background in all cases was quite large, due, probably, to poor shielding, but in any event the larger concentration of radioactivity was always found, up to the 12th week, at the very top of the column. Table 2 shows the results obtained by determining the radioactivity in the chromatographic media of the generators from FIG. 2. As explained above, generator A was prepared with the previous addition of 23 mg. of cold molybdenum. It can be seen that after 5 weeks of use, the radioactivity in this column dropped very fast, but that some radioactivity can be found down to about 4 cm. from the top, still a considerable distance from the bottom of the generator.

These data illustrate the strong and large binding capacity of molybdenum by the acid $Al_2O_3$. As can be seen in Table 3, breakthrough of aluminum was in all cases less than 6 ug, of Al/ml. of eluate, and other inert impurities were found to be of no significance, because of their very low levels (<0.1 ug./ml.). Also, sterility and apyrogenicity were never broken. Not a single growth of bacteria was observed during the testing period, and pyrogen tests, in rabbits, were always negative.

The $^{99}$Mo-99mTc generator for multiloading as described permits weekly loading, with daily elution of 99mTc possible because leakage of 99Mo in the elutes is always below the order of $10^{-4}$ of the 99mTc activity.

The generator was tested over a 3 month period and found sterile and pyrogen free, making it safe, with proper use, for medical applications, Breakthrough of long-lived nuclides and contamination of the eluents with other chemicals, such as alumina was determined and found to be well within acceptable range for human use. Alumina leakage was always below 6 ug./ml. of eluate.

Among the advantages of the described generator system are the reduced production and shipping costs, easier waste disposal, and a more efficient use of $^{99}$Mo, since about 17% of the original activity remains, at 1 week after loading.

While described in conjunction with a $^{99}$Mo-99mTc system, the generator system can be utilized with other elutable radioactive materials.

TABLE 1

SCANNING OF ACTIVITY-IN-COLUMNS FROM FIGURE 3

| AREA SCANNED From top of column (cm) | AT BEGINNING OF WEEK (in mRads/hr.) | | | | | | | |
|---|---|---|---|---|---|---|---|---|
| | 1st | 2nd | 3rd | 4th | 5th | 6th | 11th | 12th |
| 0 | >100 | >100 | >100 | >100 | >100 | >100 | >100 | >100 |
| 1.0 | 37 | 37 | 35 | 42 | 45 | 47 | 45.5 | 41 |
| 2.0 | 30 | 23.5 | 28.0 | 26.5 | 25.0 | 27.0 | 30 | 25.5 |
| 3.0 | 30 | 23.5 | 17.0 | 26.0 | 25.0 | 26.5 | 28.5 | 25.5 |
| 4.0 | 30 | 23.5 | 17.0 | 26.0 | 25.0 | 26.5 | 28.5 | 25.5 |
| 5.0 | 30 | 23.5 | 17.0 | 26.0 | 25.0 | 26.5 | 28.5 | 25.5 |
| 6.0 | 30 | 23.5 | 17.0 | 26.0 | 25.0 | 26.5 | 28.5 | 25.5 |
| 7.0 | 30 | 23.5 | 17.0 | 26.0 | 25.0 | 26.5 | 28.5 | 25.5 |
| BKG | 30 | 23.5 | 17.0 | 26.0 | 25.0 | 26.6 | 28.5 | 25.5 |

TABLE 2

ACTIVITY IN CHROMATOGRAPHIC MEDIA OF COLUMNS
(in mCi of $^{99}$Mo-99mTc in equilibrium)
After chromatographic media was separated from columns of Figure 2

| FROM TOP OF COLUMN (in cm.) | COLUMN A | COLUMN B |
|---|---|---|
| 0 to 0.5 | 11.20 | 13.4 |
| 0.5 to 1.0 | 8.55 | 7.5 |
| 1.0 to 1.5 | 3.10 | 1.2 |
| 1.5 to 2.0 | 1.09 | 0.350 |

TABLE 2-continued

ACTIVITY IN CHROMATOGRAPHIC MEDIA OF COLUMNS
(in mCi of $^{99}$Mo-99mTc in equilibrium)
After chromatographic media was separated from columns of Figure 2

| FROM TOP OF COLUMN (in cm.) | COLUMN A | COLUMN B |
|---|---|---|
| 2.0 to 2.5 | 0.93 | 0.270 |
| 2.5 to 3.0 | 0.51 | 0.138 |
| 3.0 to 3.5 | 0.221 | 0.05 |
| 3.5 to 4.0 | 0.055 | 0.05 |
| ↓ | 0.05 | 0.05 |
| 9.5 to 10 | 0.05 | 0.05 |
| BKG | 0.05 | 0.05 |

TABLE 3

TESTING THE GENERATOR

| TESTS | FREQUENCY OF TESTS | NUMBER OF TESTS | POSITIVE RESULTS | NEGATIVE RESULTS |
|---|---|---|---|---|
| Elution Efficiency | Daily | 72 | All 75% of available 99mTc | — |
| $^{99}$Mo Breakthrough | Daily | 72 | None 0.1 uCi $^{99}$Mo per mCi 99mTc | — |
| Al Breakthrough | 3 Weekly | 35 | 0.6 ug. Al/ml | — |
| Sterility | 3 Weekly | 36 | 0 | 36 |
| Pyrogenicity | 1 Weekly | 12 | 0 | 12 |
| Significant Inert Impurities | 2 Monthly | 4 | None | — |

What is claimed is:

1. A generator system that can be reloaded with an elutable radioactive material which can be used for nuclear medicine and which comprises:

an elongated column having a chromatographic bed of alumina therein and sealed at the top and bottom thereof;

transfer means arranged at the top and bottom of the column for communication with separate containers;

a first container having a predetermined amount of elutable radioactive material therein and adapted for attachment to the transfer means arranged at the top of the column;

a second container having a rinsing solution therein; and conduit means connecting the first and second containers whereby the elutable radioactive material and rinsing solution will be transferred to the column when the first container is attached to the transfer means at the top of the column and an evacuated container is attached to the transfer means at the bottom of the column.

2. The generator system of claim 1 wherein the transfer means arranged at the top of the column comprises a needle projecting outwardly through the seal thereof and communicating with the column.

3. The generator system of claim 2 wherein the transfer means arranged at the bottom of the column comprises a needle arranged for communication with the column.

4. The generator system of claim 3 wherein the elutable radioactive material contains molybdenum 99.

5. The generator system of claim 3 wherein the second container includes venting means.

6. The generator system of claim 5 wherein the chromatographic bed of alumina is retained between two spaced apart porous disks fitted within the column.

7. The generator system of claim 6 wherein a filter is interposed between the bottom of the column and the needle.

8. A method of reloading a generator system comprising an elongated column containing a chromatographic bed of alumina therein and including transfer means at the top and bottom of the column for communication with separate containers, said method comprising the steps of:

providing a first container having a predetermined amount of elutable radioactive material therein and adapted for attachment to the transfer means arranged at the top of the column;

providing a second container having a rinsing solution and conduit means connecting the first and second containers;

attaching the first container to the transfer means arranged to the top of the column to provide communication between the column and the first container; and attaching an evacuated container to the transfer means at the bottom of the container, whereby the elutable radioactive material and rinsing solution are transferred into the column.

9. The method of claim 8 wherein the elutable radioactive material contains molybdenum 99.

10. The method of claim 9 wherein the rinsing solution comprises saline solution.

* * * * *